US006155885A

United States Patent [19]

Kumakura

[11] Patent Number: 6,155,885

[45] Date of Patent: Dec. 5, 2000

[54] TERMINAL PRESS-FITTING CONSTRUCTION IN CONNECTOR HOUSING

[75] Inventor: Hideto Kumakura, Shizuoka, Japan

[73] Assignee: Yazaki Corporation, Tokyo, Japan

[21] Appl. No.: 09/432,606

[22] Filed: Nov. 3, 1999

[30] Foreign Application Priority Data

Nov. 4, 1998 [JP] Japan ..... 10-312865

[51] Int. Cl.[7] ..... H01R 13/40; H01R 9/16

[52] U.S. Cl. ..... 439/733.1; 439/752.5; 439/869

[58] Field of Search ..... 439/752.5, 733.1, 439/680, 869, 444, 603, 751

[56] References Cited

U.S. PATENT DOCUMENTS 5,961,351 10/1999 Wu ..... 439/610

FOREIGN PATENT DOCUMENTS 8-17512 1/1996 Japan .

*Primary Examiner*—Paula Bradley
*Assistant Examiner*—Edwin A. Leon
*Attorney, Agent, or Firm*—Sughrue, Mion, Zinn, Macpeak & Seas, PLLC

[57] ABSTRACT

A terminal press-fitting construction in a connector housing includes terminal press-fitting open holes 22, formed in the connector housing 21, and terminals 23 inserted respectively in the terminal press-fitting open holes 22 in a press-fitted manner. Chamfered portions 25 are formed on an inner surface of the terminal press-fitting open hole 22, and four corner portions 24 of the male tab-like terminal 23 abut respectively against the chamfered portions 25 to slide respectively on these chamfered portions during a press-fitting operation so that the corner portions 24 can achieve a press-fitting effect. An opening of the terminal press-fitting open hole 22, when viewed in a direction of an axis thereof, has a polygonal shape (i.e., octagonal shape) having sides twice larger in number than the corner portions 24. The terminal 23 is inserted into this press-fitting open hole.

3 Claims, 7 Drawing Sheets

TERMINAL PRESS-FITTING CONSTRUCTION IN CONNECTOR HOUSING

BACKGROUND OF INVENTION

1. Field of the Invention

This invention relates to a terminal press-fitting construction including terminal press-fitting open holes, formed in a connector housing, and terminals inserted respectively in the terminal press-fitting open holes in a press-fitted manner.

2. Related art

A terminal press-fitting construction of the type described will be described with reference to FIG. 8.

A connector 1 includes connector housing 2, and male terminals 3 each having a round pin-shaped distal end portion 3*a* and a press-fitting portion 3*b*. In this terminal press-fitting construction, the male terminal 3 is press-fitted liquid-tight into a terminal press-fitting open hole 5 formed through an inner wall 4 of the connector housing 2.

After the male terminal 3 is thus press-fitted, a potting resin 7 is filled in a tubular potting cup 6 formed on a rear side of the inner wall 4, and the distal end portion 3*a* of the male terminal 3 projects from the front side of the inner wall 4 for electrical connection to a female terminal (not shown).

This terminal press-fitting construction in the connector 1 will be described in further detail. As shown in FIG. 9(*a*), the terminal press-fitting open hole 5 has an opening with a diameter $\phi$ when viewed in the direction of the axis of the open hole 5. As shown in FIG. 9(*b*), the press-fitting portion 3*b* of the male terminal 3 has a transverse cross-section (perpendicular to the axis of the male terminal 3) having a diameter $\phi'$. The diameters $\phi$ and $\phi'$ are so determined that $\phi<\phi'$ is established, and the difference between the two diameters serves as a press-fitting amount, and the male terminal 3 is press-fitted and inserted into the terminal press-fitting open hole 5 while the press-fitting portion 3*b* forcibly expanding the terminal press-fitting open hole 5.

The male terminal 3 is held in intimate contact with the inner surface of the terminal press-fitting open hole 5 to form a seal therebetween, thereby preventing the leakage of the potting resin 7 (see FIG. 8).

Besides the terminal press-fitting construction employing the round pin-shaped terminals, there is also known a terminal press-fitting construction (as shown in FIGS. 10(*a*) and 10(*b*)) which includes terminal press-fitting open holes 8 of a rectangular cross-section (formed in a connector housing (not shown)), and tab-like male terminals 9 of a rectangular cross-section each for press-fitting into the associated terminal press-fitting open hole 8.

Namely, an opening of the terminal press-fitting open hole 8 has a rectangular cross-section when viewed in the direction of the axis of the open hole 8, and this open hole 8 has a width w1 and a thickness w2. The male terminal 9 has a width w3 and a thickness w4. These dimensions are so determined that w1<w3 and w2<w4 are established.

Therefore, the differences in these dimensions serve as a press-fitting amount, and as in the above terminal press-fitting construction (see FIG. 9), the male terminal 9 is press-fitted and inserted into the terminal press-fitting open hole 8 while forcibly expanding the terminal press-fitting open hole 8.

In the above conventional constructions, the terminal press-fitting open hole is forcibly expanded when press-fitting and inserting the male terminal thereinto, and therefore the operator is required to apply to the male terminal an inserting force larger than a compressive stress of a material (resin) of which the connector housing is made.

This inserting force acts on the terminal press-fitting open hole through the entire periphery of the male terminal, and therefore becomes a very large load, and when the inserting operation is effected for a long period of time, the efficiency of the operation is much lowered.

If the direction of press-fitting of the male terminal into the terminal press-fitting open hole does not fully coincide with the direction of application of the load by the operator, there is a possibility that the male terminal is deformed since the male terminal must be pressed into the terminal press-fitting open hole with a very large load as described above. This creates another cause of the lowered operation efficiency.

The sealing effect can be achieved by holding the male terminal and the inner surface of the terminal press-fitting open hole in intimate contact with each other, and therefore it is thought that the inserting force can be reduced by reducing the press-fitting amount as much as possible.

However, it is also necessary to provide the proper function of retaining the male terminal in position, and therefore in the above terminal press-fitting constructions, the press-fitting amount can not be reduced sufficiently regardless of the sealing effect.

Therefore, the above problems have not yet been solved, and there is still room for improvement.

SUMMARY OF INVENTION

The present invention has been made in view of the above problems, and an object of the invention is to provide a terminal press-fitting construction in a connector housing, in which the efficiency of the operation can be enhanced without affecting a terminal-retaining function while securing a proper sealing effect.

According to a first aspect of the present invention, a terminal press-fitting construction in a connector housing, which includes terminal press-fitting open holes, formed in the connector housing, and terminals inserted respectively in the terminal press-fitting open holes in a press-fitted manner; provided in that chamfered portions are formed on an inner surface of the terminal press-fitting open hole, and corner portions of the terminal abut respectively against the chamfered portions to slide respectively on the chamfered portions during a press-fitting operation so that the corner portions can achieve a press-fitting effect; and an opening of the terminal press-fitting open hole, when viewed in a direction of an axis thereof, has a polygonal shape having sides twice larger in number than the corner portions.

In the above construction, the corner portions of the terminal slide respectively on the chamfered portions of the terminal press-fitting open hole so as to achieve the press-fitting effect, and therefore these corner portions are held in line-contact with the terminal press-fitting open hole. Namely, when the terminal is inserted, the corner portions of the terminal first abut against the chamfered portions of the terminal press-fitting open hole, respectively, and then slide on these chamfered portions, respectively. Therefore,the terminal is not press-fitted through the entire periphery thereof in contrast with the conventional construction.

Therefore, at the time of starting the press-fitting operation, the terminal can be press-fitted (inserted) without applying to the terminal a large load as required in the conventional construction, and even if the press-fitting (inserting) operation is effected for a long period of time, it will not become a burden to the operator. Therefore,the efficiency of the operation is markedly enhanced.

A half of the surfaces, forming the terminal press-fitting open hole, are the chamfered portions, and the terminal can be retained only by the chamfered portions, and therefore a press-fitting amount with respect to the remaining surfaces can be determined depending on whether or not a sealing effect is necessary.

Therefore, if the sealing effect is necessary, there is provided an arrangement in which the terminal can contact at least the remaining surfaces, and if the sealing effect is not necessary, a gap is formed therebetween so as to reduce the inserting force.

Therefore, there can be provided the terminal press-fitting construction in the connector housing, in which the efficiency of the operation can be enhanced without affecting the terminal-retaining function while securing the proper sealing effect.

The corner portion does not merely mean a corner of the terminal (that is, an edge portion), but means a corner portion including a surface and a radiused surface formed on the edge portion in the production.

In the terminal press-fitting construction (in the connector housing) of a second aspect of the present invention of according to the first aspect of the present invention, the opening of the terminal press-fitting open hole, when viewed in the direction of the axis thereof, has an octagonal shape, and a length of the terminal press-fitting open hole except the chamfered portions in a direction of a width thereof is shorter than a width of a tapering distal end portion of the terminal, and a length of the terminal press-fitting open hole except the chamfered portions in a direction of a thickness thereof is shorter than a thickness of the distal end portion.

In the above construction, the length of the terminal press-fitting open hole except the chamfered portions in the direction of the width thereof, the length of the terminal press-fitting open hole except the chamfered portions in the direction of the thickness thereof, and the width and thickness of the terminal are determined as described above, and therefore the corner portions positively abut against the chamfered portions, respectively, so that misalignment of the terminal can be kept to a minimum when inserting the terminal.

Therefore, the terminal can be press-fitted in a stable manner, and the efficiency of the operation can be enhanced.

In the terminal press-fitting construction (in the connector housing) of a third aspect according to the second aspect of the present invention, a total length of the terminal press-fitting open hole in the direction of the width thereof is slightly shorter than or equal to a width of a base portion of the terminal, and a total length of the terminal press-fitting open hole in the direction of the thickness thereof is slightly shorter than a thickness of the base portion.

In the above construction, the total length of the terminal press-fitting open hole in the direction of the width thereof, the total length of the terminal press-fitting open hole in the direction of the thickness thereof and the width and thickness of the base portion of the terminal are determined as described above, and therefore the terminal is positively sealed. The terminal is retained at the corner portions as described above, and therefore there can be adopted the above construction in which the sealing effect is regarded as being important. When a press-fitting amount is provided, the efficiency of the operation will not be affected if this press-fitting amount is kept as small as possible.

Therefore, the sealing effect is positively secured, and the efficiency of the operation is enhanced.

The total length means the length without the chamfered portions, and is equal to the distance between the parallel opposed surfaces.

DETAILED DESCRIPTION OF PREFERRED EMBODIMENTS

Figure 1:
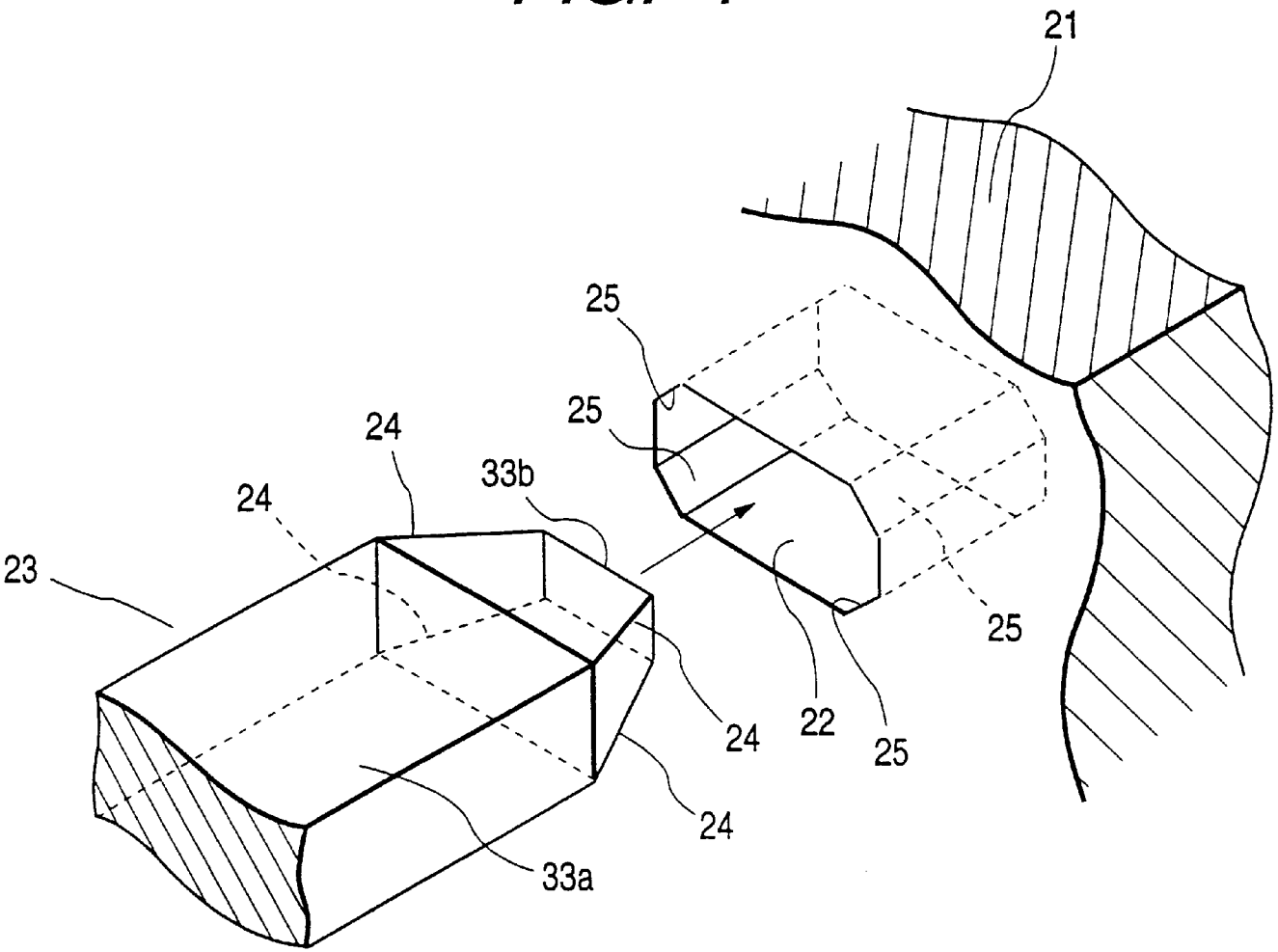
FIG. 1 is a perspective view of one preferred embodiment of a terminal press-fitting construction of the invention in a connector housing.

One preferred embodiment of the present invention will now be described with reference to the drawings. FIG. 1 is a perspective view of one preferred embodiment of a terminal press-fitting construction of the invention in a connector housing.

Figure 2A:
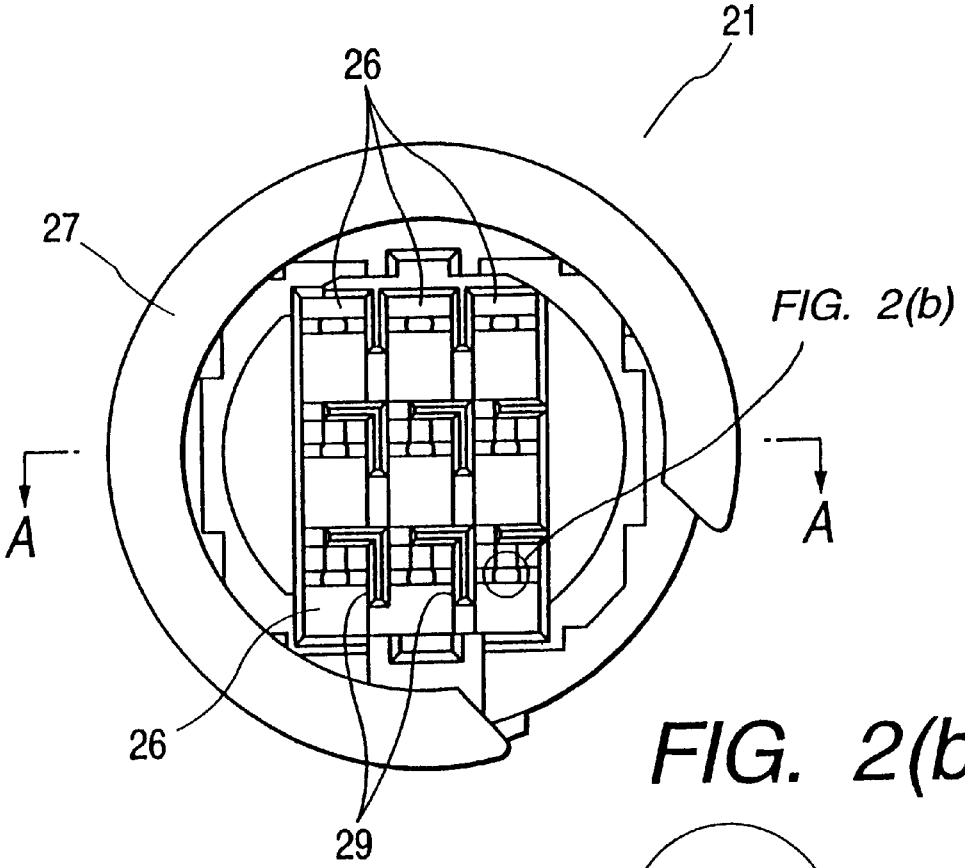
FIG. 2 is a plan view of the connector housing as viewed in a terminal inserting direction (An encircled portion is an enlarged view of an important portion).
Figure 2B:
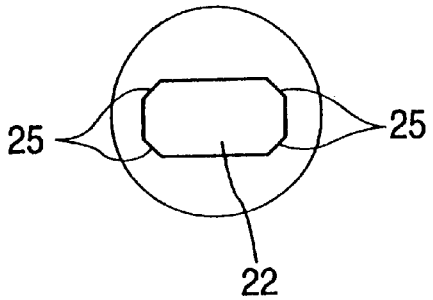
Figure 3:
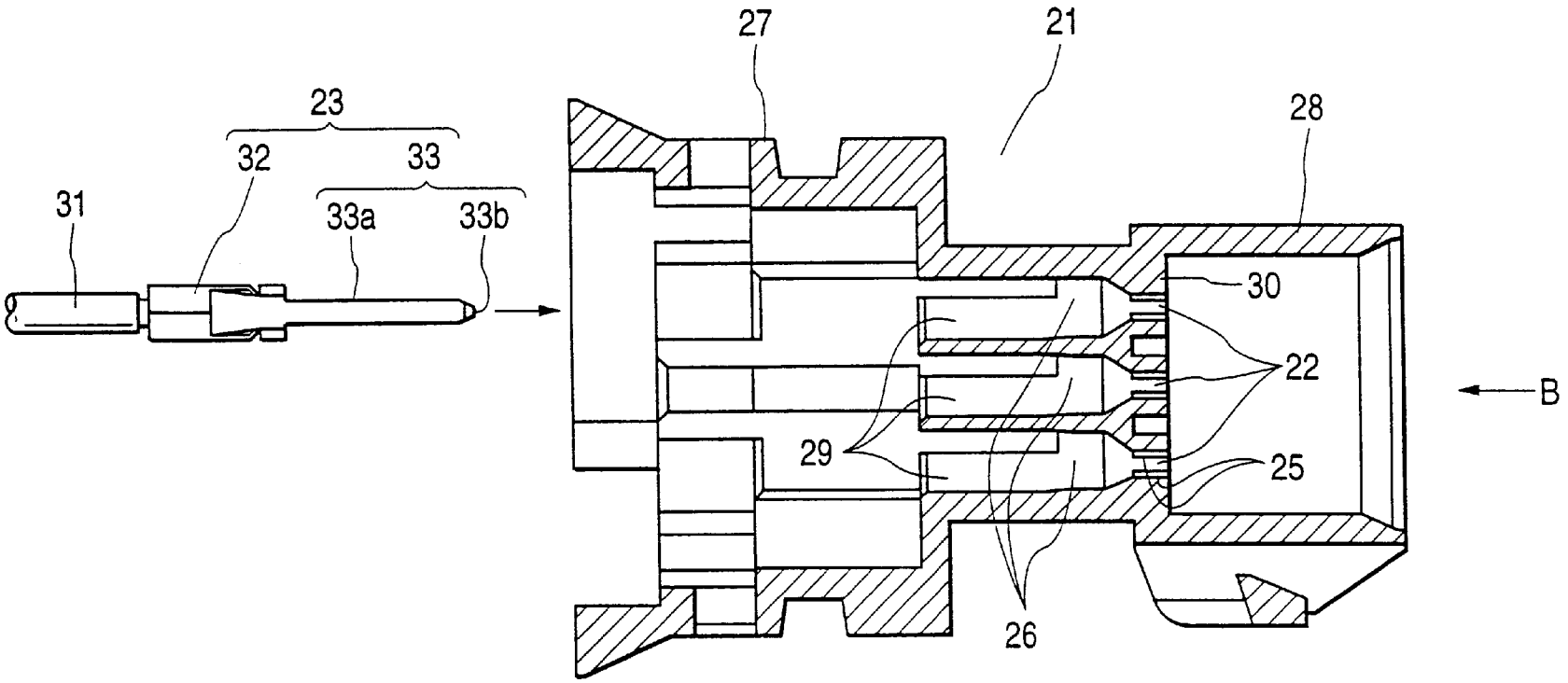
FIG. 3 is a cross-sectional view of the connector housing taken along the line A—A of FIG. 2.
Figure 4A:
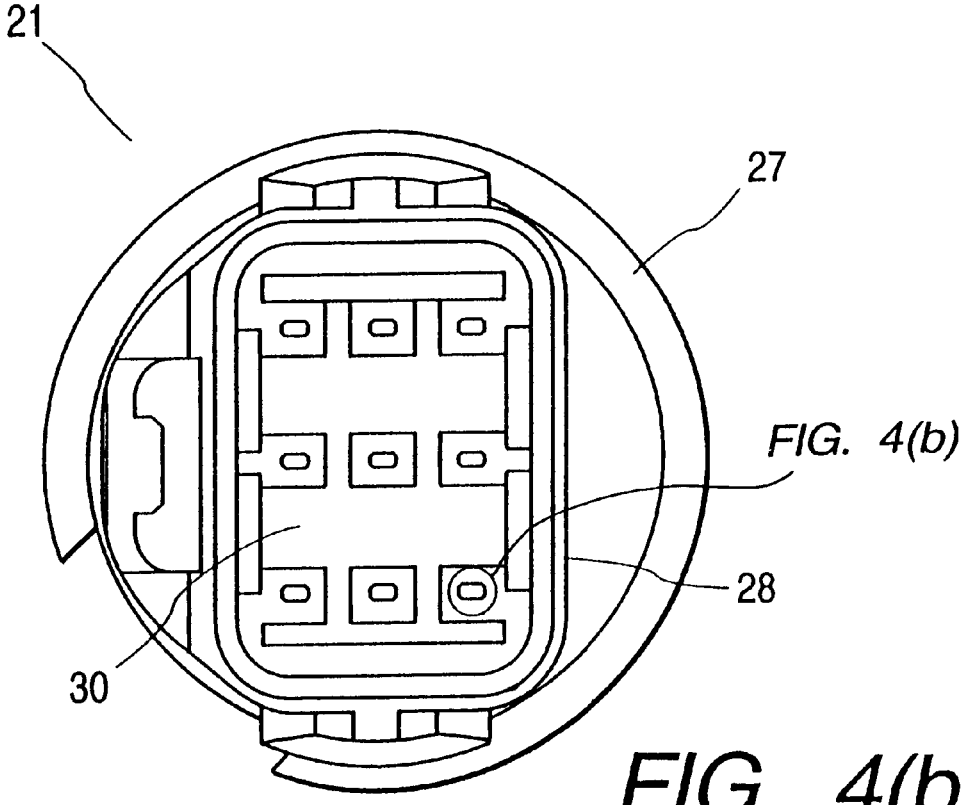
FIG. 4 is a view of the connector housing as viewed in a direction of arrow B of FIG. 3 (An encircled portion is an enlarged view of an important portion).
Figure 4B:
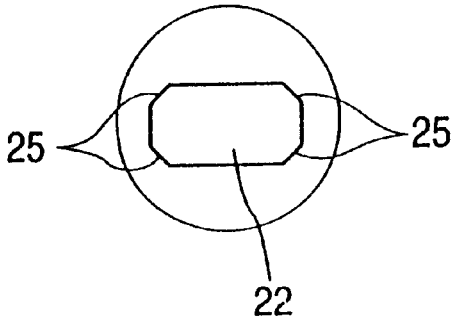

FIG. 2 is a plan view of the connector housing as viewed in a terminal inserting direction (An encircled portion is an enlarged view of an important portion), FIG. 3 is a cross-sectional view of the connector housing taken along the line A—A of FIG. 2, and FIG. 4 is a view of the connector housing as viewed in a direction of arrow B of FIG. 3 (An encircled portion is an enlarged view of an important portion).

In FIG. 1, the terminal press-fitting construction of the invention (in the connector housing) includes terminal press-fitting open holes 22 formed in the connector housing 21, and terminals 23 which are press-fitted and inserted into the terminal press-fitting open holes 22, respectively. In one example, four chamfered portions 25 are formed on an inner surface of the terminal press-fitting open hole 22, and four corner portions 24 of the male tab-like terminal 23 about respectively against the chambered portions 25 to slide respectively on these chamfered portions 25 during a press-fitting operation so that the corner portions 24 can achieve the press-fitting effect. An opening of the terminal press-fitting open hole 22, when viewed in a direction of the axis thereof, has a polygonal (i.e., octagonal) shape having sides twice larger in number than the corner portions 24. The terminal 23 is inserted into this opening.

The connector housing 21 will be described more specifically with reference to FIGS. 2 to 5.

As shown in FIGS. 2 and 3, the connector housing 21 is made of a synthetic resin, and is formed into a generally cylindrical shape. A plurality of terminal receiving chambers 26 are formed within the connector housing at a generally central portion thereof. A cup-shaped bulge portion 27 (see FIG. 3), larger in diameter than that portion of the connector housing 21 having the terminal receiving chambers 26, is formed at a rear portion of the connector housing 21, that is, at the rear side of the terminal receiving chambers 26 from which the terminals 23 (see FIG. 3) are inserted. A fitting portion 28 (see FIGS. 3 and 4) of a generally rectangular shape for fitting on a mating connector (not shown) is formed at a front portion of the connector housing.

The terminal receiving chambers 26 are separated from one another by cross-sectionally L-shaped guides 29, and the terminal press-fitting open holes 22 are formed through a partition wall 30 formed between the fitting portion 28 (see FIGS. 3 and 4) and the terminal receiving chambers 26. Because of the provision of the chamfered portions 25, the opening of the terminal press-fitting open hole 22, when viewed in the direction of the axis thereof, has an elongate octagonal shape much like a rectangular shape with four corner portions cut off. The terminal press-fitting open hole 22, having such a shape throughout the length thereof, communicates the terminal receiving chamber 26 with the fitting portion 28 (see FIG. 3).

Figure 5:
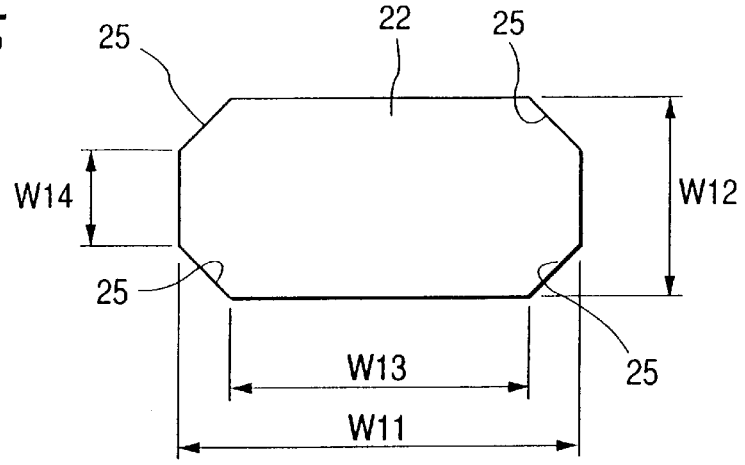
FIG. 5 is a view explanatory of dimensions of a terminal press-fitting open hole in FIGS. 2 and 4.

The terminal press-fitting open hole 22 will be described in further detail. As shown in FIG. 5, the open hole 22 has a total length (width) W11 in the direction of the width thereof (corresponding to the direction of the width of the terminal 23), and a total length (thickness) W12 in the direction of the thickness thereof (corresponding to the direction of the thickness of the terminal 23). A length of the open hole 22 except the chamfered portions 25 in the direction of the width is represented by W13, and a length of the open hole 22 except the chamfered portions 25 in the direction of the thickness is represented by W14. The inclination of the chamfered portions 25 can be suitably determined by changing the length W13 or the length W14.

As will be appreciated from the above description and the drawings, the total lengths mean the lengths of the sides of the rectangle without the chamfered portions 25, and the total length (width) is equal to the distance between the opposed shorter sides, and the total length (thickness) is equal to the distance between the opposed longer sides.

As shown in FIG. 3 which is a side-elevational view, the terminal 23 to be inserted into the terminal press-fitting open hole 22 includes a wire connecting portion 32 for being pressed to hold a wire 31, and a male tab-like electrical contact portion 33 extending from the wire connecting portion 32. The terminal 23 is formed by pressing a metal sheet of good electrical conductivity into a predetermined shape.

Figure 6A:
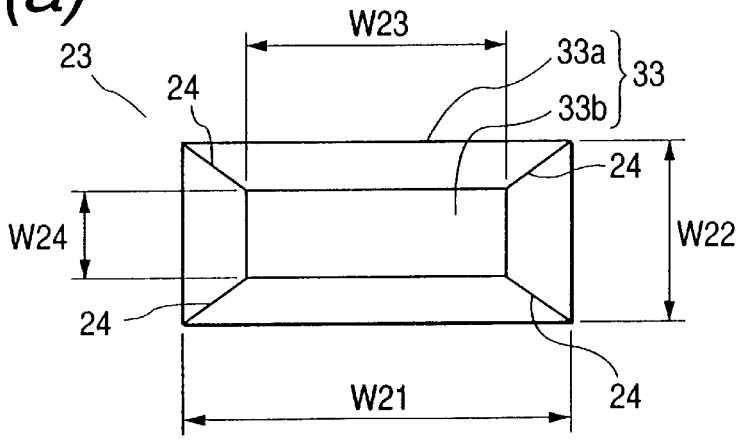
FIG. 6(*a*) a front-elevational of a male terminal of FIG. 3, showing its distal end portion, and FIG. 6(*b*) is a plan view of the male terminal of FIG. 3.
Figure 6B:
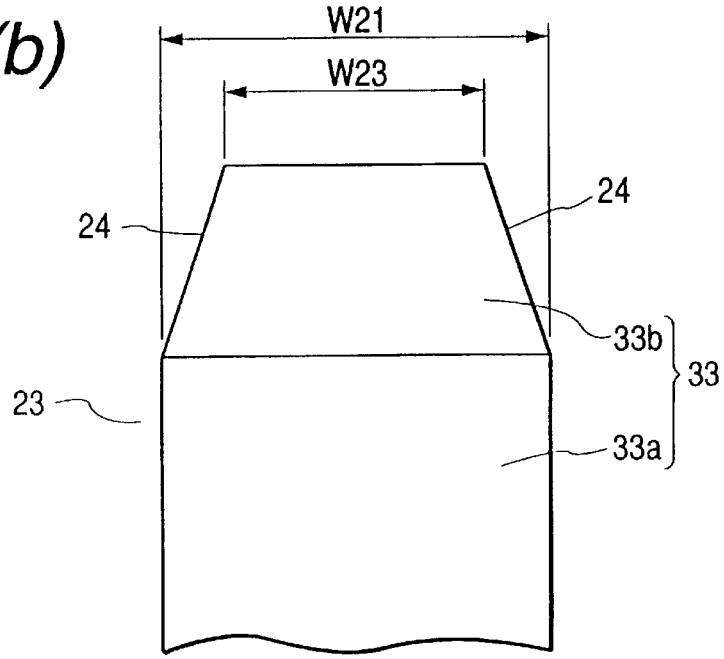

As shown in FIGS. 6(*a*) and 6(*b*), the electrical contact portion 33 includes a base portion 33*a* , and a tapering distal end portion 33*b* . The electrical contact portion 33 has a rectangular transverse cross-section, and therefore has four corner portions 24.

The base portion 33*a* has a width W21 and a thickness W22, and the distal end portion 33*b* has a width W23 and a thickness W24.

The corner portion 24 does not merely mean a corner of the terminal 23 (that is, an edge portion extending continuously over the base portion 33*a* and the distal end portion 33*b* ), but means a corner portion including a surface and a radiused surface formed on the edge portion in the production.

In the above construction, the dimensional relation between the terminal press-fitting open hole 22 and the electrical contact portion 33 is as follows (see FIGS. 5 and 6).

The length W13 of the terminal press-fitting open hole 22 in the direction of the width is shorter than the width 23 of the distal end portion 33*b* (W13<W23), and the length W14 of the terminal press-fitting open hole 22 in the direction of the thickness is shorter than the thickness W24 of the distal end portion 33*b* (W14<W24).

The total length W11 of the terminal press-fitting open hole 22 in the direction of the width is slightly shorter than or equal to the width W21 of the base portion 33*a* (W11≦W21 (W11_W21 may be acceptable)), and the total length W12 of the terminal press-fitting open hole 22 in the direction of the thickness is slightly shorter than or equal to the thickness W22 of the base portion 33*a* (W12≦W22 (W12_W22 may be acceptable)).

Figure 7A:
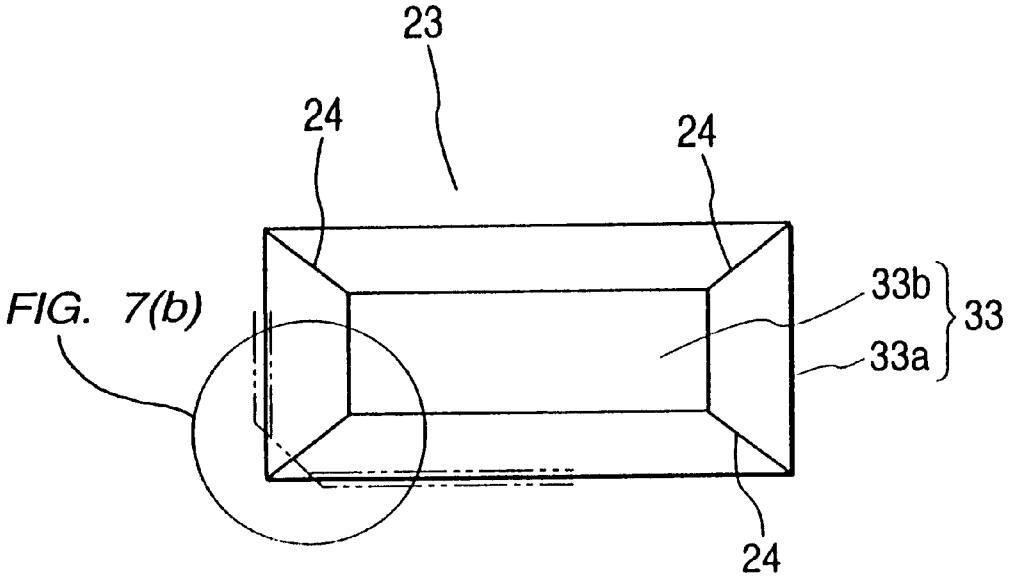
FIG. 7 is a view explanatory of the manner of press-fitting the terminal of FIG. 6(*a*) into the terminal press-fitting open hole of FIG. 5.
Figure 7B:
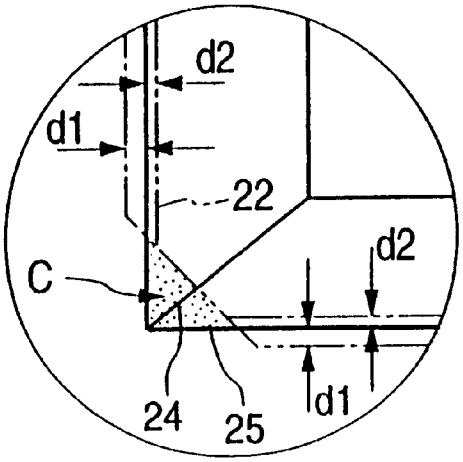

In this dimensional relation, when the terminal 23 is inserted into the terminal receiving chamber 26 as shown in FIG. 3, the corner portions 24 (see FIG. 7) are brought into contact with the chamfered portions 25, respectively, at four points, and then slide respectively on the chamfered portions 25 (in line-contact therewith) to forcibly expand the chamfered portions 25. Overlapping portions (indicated by arrow C) of each corner portion 24 and the associated chamfered portion 25 contribute to the retaining of the terminal 23, and therefore the terminal is maintained in a stably-retained condition.

If it is not necessary to take the sealing effect into consideration, a gap d1 is formed between the terminal press-fitting open hole 22 and the base portion 33*a* so as to greatly reduce the force required for inserting the terminal 23. In contrast, in this embodiment, the above dimensional relation is so determined as to provide the sealing construction, and therefore in this terminal press-fitting construction, the base portion 33*a* is held in contact with the terminal press-fitting open hole 22, or is compressed in an amount d2. This compression amount d2 can be determined without taking the retaining of the terminal 23 into consideration, and therefore can be made as small as possible so as to reduce the inserting force.

Figure 8:
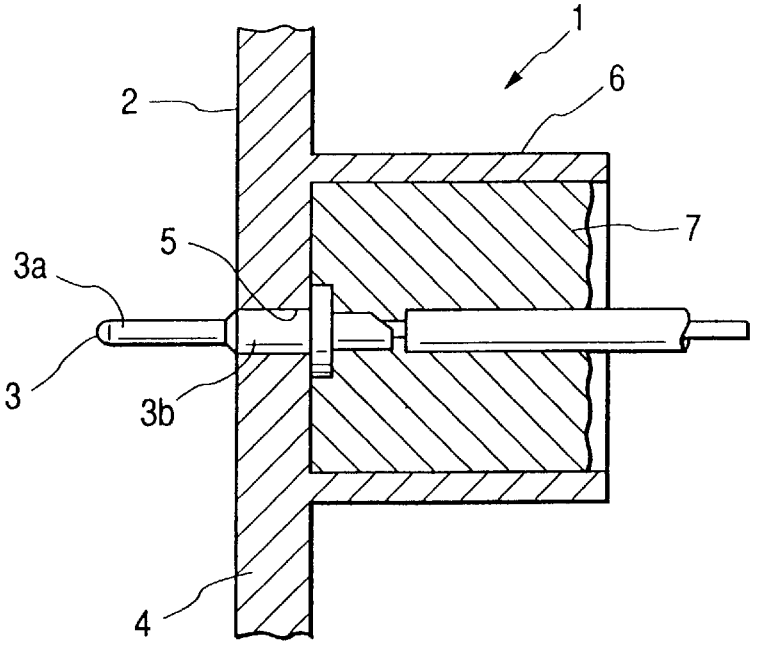
FIG. 8 is a cross-sectional view of a connector, showing a terminal press-connecting construction in a conventional connector housing.
Figure 9A:
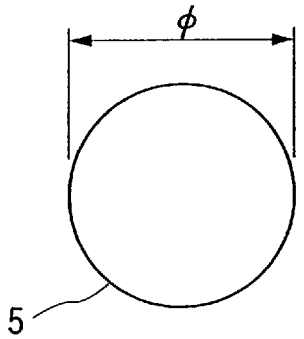
FIG. 9(*a*) is a view explanatory of a dimension of a terminal press-fitting open hole of FIG. 8, and FIG. 9(*b*) is a cross-sectional view of a male terminal of FIG. 8.
Figure 9B:
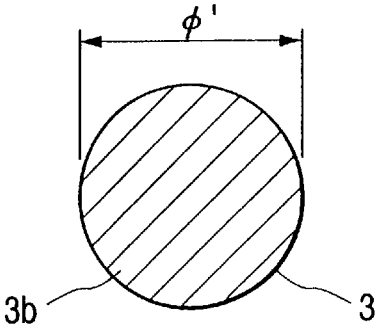
Figure 10A:
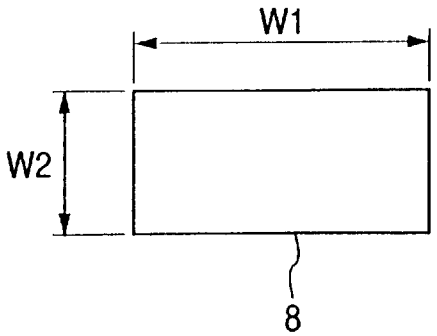
FIG. 10(*a*) is a view explanatory of dimensions of a terminal press-fitting open hole of other conventional construction than that of FIG. 9(*a*), and FIG. 10(*b*) is a cross-sectional view of other conventional male terminal than that of FIG. 9(*b*).
Figure 10B:
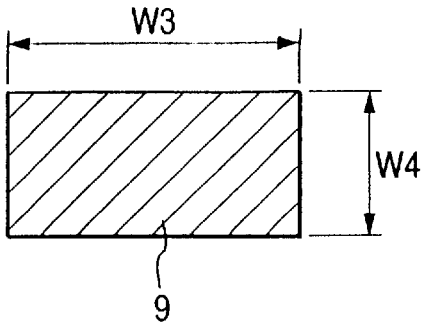

As described above, the corner portions 24 of the terminal 23 slide respectively on the chamfered portions 25 of the terminal press-fitting open hole 22 so as to achieve the press-fitting effect, and in this terminal press-fitting construction, the male terminal is not press-fitted through the entire periphery of the male terminal in contrast with the conventional construction in which the press-fitting insertion is effected through the entire periphery of the conventional male terminal 3 (see FIG. 8).

Therefore, at the time of starting the press-fitting operation, the terminal 23 can be press-fitted (inserted) without applying to the terminal 23 a large load as required in the conventional construction, and even if the press-fitting (inserting) operation is effected for a long period of time, it will not become a burden to the operator.

In the above dimensional relation, the corner portions 24 positively abut against the chamfered portions 25, respectively, and therefore when inserting the terminal 23, misalignment of the terminal 23 can be kept to a minimum, and the terminal 23 can be press-fitted in a stable manner. And besides, the sealing effect can be positively secured.

Therefore, there can be provided the terminal press-fitting construction in the connector housing, in which the efficiency of the operation is markedly enhanced.

In the present invention, various modifications can be made without departing from the scope of the invention.

The cross-section of the male terminals is not limited to a square shape, but can be a triangular shape, a hexagonal shape and other shape. The present invention can be applied to a construction in which a female terminal or a male terminal of other form is retained in each terminal receiving chamber.

As described above, in the present invention, the corner portions of the terminal slide respectively on the chamfered portions of the terminal press-fitting open hole so as to achieve the press-fitting effect, and therefore these corner portions are held in line-contact with the terminal press-fitting open hole. Namely, when the terminal is inserted, the corner portions of the terminal first abut against the chamfered portions of the terminal press-fitting open hole, respectively, and then slide on these chamfered portions, respectively. Therefore, the terminal is not press-fitted through the entire periphery thereof in contrast with the conventional construction.

Therefore, at the time of starting the press-fitting operation, the terminal can be press-fitted (inserted) without applying to the terminal a large load as required in the conventional construction, and even if the press-fitting (inserting) operation is effected for a long period of time, it will not become a burden to the operator. Therefore, the efficiency of the operation is markedly enhanced.

A half of the surfaces, forming the terminal press-fitting open hole, are the chamfered portions, and the terminal can be retained only by the chamfered portions, and therefore a press-fitting amount with respect to the remaining surfaces can be determined depending on whether or not a sealing effect is necessary.

Therefore, if the sealing effect is necessary, there is provided an arrangement in which the terminal can contact at least the remaining surfaces, and if the sealing effect is not necessary, a gap is formed therebetween so as to reduce the inserting force.

Therefore, advantageously, there can be provided the terminal press-fitting construction in the connector housing, in which the efficiency of the operation can be enhanced without affecting the terminal-retaining function while securing the proper sealing effect.

In the present invention, the length of the terminal press-fitting open hole except the chamfered portions in the direction of the width thereof, the length of the terminal press-fitting open hole except the chamfered portions in the direction of the thickness thereof, and the width and thickness of the terminal are determined as described above, and therefore the corner portions positively abut against the chamfered portions, respectively, so that misalignment of the terminal can be kept to a minimum when inserting the terminal.

Therefore, advantageously, the terminal can be press-fitted in a stable manner, and the efficiency of the operation can be enhanced.

In the present invention, the total length of the terminal press-fitting open hole in the direction of the width thereof, the total length of the terminal press-fitting open hole in the direction of the thickness thereof and the width and thickness of the base portion of the terminal are determined as described above, and therefore the terminal is positively sealed. The terminal is retained at the corner portions as described above, and therefore there can be adopted the above construction in which the sealing effect is regarded as being important. When a press-fitting amount is provided, the efficiency of the operation will not be affected if this press-fitting amount is kept as small as possible.

Therefore, advantageously, the sealing effect is positively secured, and the efficiency of the operation is enhanced.

What is claimed is:

1. A terminal press-fitting construction comprising:

a connector housing including press-fitting open holes;

terminals inserted respectively in said terminal press-fitting open holes in a press-fitted manner;

chamfered portions formed on an inner surface of said terminal press-fitting open hole, and corner portions of said terminal abut respectively against said chamfered portions to slide respectively on said chamfered portions during a press-fitting operation so that said corner portions can achieve a press-fitting effect, and an opening of said terminal press-fitting open hole, when viewed in a direction of an axis thereof, having a polygonal shape having sides twice larger in number than said corner portions.

2. A terminal press-fitting construction in a connector housing according to claim 1, wherein the opening of said terminal press-fitting open hole, when viewed in the direction of the axis thereof, has an octagonal shape, and a length of said terminal press-fitting open hole except said chamfered portions in a direction of a width thereof is shorter than a width of a tapering distal end portion of said terminal, and a length of said terminal press-fitting open hole except said chamfered portions in a direction of a thickness thereof is shorter than a thickness of said distal end portion.

3. A terminal press-fitting construction in a connector housing according to claim 2, wherein a total length of said terminal press-fitting open hole in the direction of the width thereof is slightly shorter than or equal to a width of a base portion of said terminal, and a total length of said terminal press-fitting open hole in the direction of the thickness thereof is slightly shorter than a thickness of said base portion.

* * * * *